US009410729B2

(12) United States Patent
Kang

(10) Patent No.: US 9,410,729 B2
(45) Date of Patent: Aug. 9, 2016

(54) REAGENT REFRIGERATOR

(75) Inventor: Yeon Kyun Kang, Daejeon (KR)
(73) Assignee: GTSCIEN CO., LTD, Daejeon (KR)

( * ) Notice: Subject to any disclaimer, the term of this patent is extended or adjusted under 35 U.S.C. 154(b) by 721 days.
(21) Appl. No.: 13/695,157
(22) PCT Filed: May 3, 2011
(86) PCT No.: PCT/KR2011/003297
§ 371 (c)(1),
(2), (4) Date: Oct. 29, 2012
(87) PCT Pub. No.: WO2012/008681
PCT Pub. Date: Jan. 19, 2012
(65) Prior Publication Data

US 2013/0036755 A1 Feb. 14, 2013
(30) Foreign Application Priority Data
Jul. 13, 2010 (KR) ..... 10-2010-0067225
(51) Int. Cl.
*F25D 17/06* (2006.01)
*F25D 17/04* (2006.01)
(Continued)
(52) U.S. Cl.
CPC ..... *F25D 17/042* (2013.01); *B01L 1/50* (2013.01);
(Continued)
(58) Field of Classification Search
CPC ..... F25D 17/042; F25D 2317/041; B01D 46/0019; B01D 46/0023; B01D 53/02; B01D 53/04; B01D 53/0407; B01D 53/0415; B01D 53/14; B01D 53/1406; B01D 53/1437
USPC ..... 55/315; 96/108, 134, 121, 131, 132; 95/90; 502/400, 415; 422/171, 177, 422/122
See application file for complete search history.

(56) References Cited

U.S. PATENT DOCUMENTS 2,962,875 A * 12/1960 Barroero ..... A47F 3/0452 62/256

(Continued)

FOREIGN PATENT DOCUMENTS

DE 102010014224 A1 * 10/2010
JP 01-288342 A 11/1989

(Continued)

OTHER PUBLICATIONS

International Search Report, mailed Jan. 2, 2012 in connection with PCT International Application No. PCT/KR2011/003297, filed May 3, 2011.

(Continued)

*Primary Examiner* — Allen Flanigan
*Assistant Examiner* — Kun Kai Ma
(74) *Attorney, Agent, or Firm* — John P. White; Cooper & Dunham LLP

(57) ABSTRACT

The present invention relates to a reagent refrigerator which comprises a reagent refrigerator compartment including reagent storing trays; an upper housing a cooling equipment compartment and a cooling purification compartment; a side duct defined by a side partition having a through hole at the side of the reagent refrigerator; one each of a second side duct, separately defined by a side partition having a through hole at the other side thereof, and a rear duct, separately defined by a rear partition having a through hole at the rear side thereof; and an upper duct having one end communication with the upper portion of the second side or rear side, and the other end communicating with the cooling purification compartment. Accordingly, refrigeration temperature of the reagent refrigerator can be controlled, and circulation flow in the reagent refrigerator is improved, to thereby purify the air therein and minimize deviations from refrigerator temperature values. In addition, since the reagent refrigerator is based on a closed circulation type structure, impurities are prevented from being introduced to the reagent refrigerator to thereby increase the service life of the filter and reduce energy consumption. Moreover, even when the door of the reagent refrigerator is opened, negative pressure distribution in the reagent refrigerator is relatively even, thereby preventing the emission of noxious gas and an offensive smell from the reagent refrigerator compartment to the indoor space. More particularly, the reagent refrigerator may be modified to have a partial opening circulation structure without a heater to thereby prevent explosions and to perform a defrosting/dehumidifying operation so that safety and economic feasibility can be improved. In addition, the reagent refrigerator can be automatically controlled and the internal condition of the reagent refrigerator compartment can be monitored in real time. Furthermore, not only can on-site/real-time control be executed, but remote control as well.

18 Claims, 7 Drawing Sheets

(51) Int. Cl.
*B01L 1/00* (2006.01)
*B01L 3/00* (2006.01)

(52) U.S. Cl.
CPC ..... *B01L 3/52* (2013.01); *B01L 2200/082* (2013.01); *B01L 2200/141* (2013.01); *B01L 2200/16* (2013.01); *B01L 2300/1894* (2013.01); *F25D 2317/041* (2013.01)

(56) References Cited

U.S. PATENT DOCUMENTS

| | | | | | |
|---|---|---|---|---|---|
| 3,702,544 | A * | 11/1972 | Grinups | F25D 17/06 | 62/414 |
| 3,992,171 | A * | 11/1976 | Jenewein | 62/419 | |
| 4,690,763 | A * | 9/1987 | Rieger et al. | 210/496 | |
| 5,087,070 | A * | 2/1992 | O'Loughlin | B60R 21/2644 | 280/736 |
| 5,198,006 | A * | 3/1993 | Mimori et al. | 55/523 | |
| 5,204,068 | A * | 4/1993 | O'Loughlin | B01D 39/2041 | 280/736 |
| 5,678,413 | A * | 10/1997 | Jeong | F25D 17/065 | 62/186 |
| 5,924,912 | A * | 7/1999 | Takehana | B24C 1/04 | 430/284.1 |
| 5,924,921 | A * | 7/1999 | Yang | 454/253 | |
| 6,595,429 | B1 * | 7/2003 | Carlson et al. | 236/44 R | |
| 6,615,908 | B1 * | 9/2003 | Bosher et al. | 165/48.1 | |
| 7,641,707 | B2 * | 1/2010 | Kang | B01D 46/0006 | 55/385.1 |
| 2003/0041572 | A1 * | 3/2003 | Lohr et al. | 55/385.2 | |
| 2004/0144124 | A1 * | 7/2004 | Bottom | A23B 7/148 | 62/407 |
| 2004/0146436 | A1 * | 7/2004 | Ham et al. | 422/177 | |
| 2004/0260139 | A1 * | 12/2004 | Klabunde et al. | 585/820 | |
| 2005/0217223 | A1 * | 10/2005 | Ryan et al. | 55/385.2 | |
| 2005/0244306 | A1 * | 11/2005 | Stahl | B01L 1/50 | 422/400 |
| 2006/0265979 | A1 * | 11/2006 | Cording | 52/204.5 | |
| 2007/0157645 | A1 * | 7/2007 | Anell et al. | 62/187 | |
| 2008/0250797 | A1 * | 10/2008 | Rozendaal et al. | 62/127 | |
| 2009/0133427 | A1 * | 5/2009 | Malisi | 62/275 | |

FOREIGN PATENT DOCUMENTS

| | | | |
|---|---|---|---|
| JP | 11264647 | A * | 9/1999 |
| JP | 2009045225 | A * | 3/2009 |
| KR | 20-0440284 | Y1 | 6/2008 |
| KR | 10-2010-0009199 | A | 1/2010 |
| KR | 10-0941666 | | 2/2010 |

OTHER PUBLICATIONS

Written Opinion of the International Searching Authority, mailed Jan. 2, 2012, in connection with PCT International Application No. PCT/KR2011/003297, filed May 3, 2011.

Notification Concerning Transmittal of International Preliminary Report on Patentability (Chapter I of the Patent Cooperation Treaty), including an International Preliminary Report on Patentability and Written Opinion of the International Searching Authority, mailed Jan. 24, 2013 by The International Bureau of WIPO in connection with PCT International Application No. PCT/KR2011/003297, filed May 3, 2011.

* cited by examiner

REAGENT REFRIGERATOR

CROSS-REFERENCE TO RELATED APPLICATIONS

This application is a §371 national stage of PCT International Application No. PCT/KR2011/003297, filed May 3, 2011, claiming priority of Korean Patent Application No. 10-2010-0067225, filed Jul. 13, 2010, the contents of each of which are hereby incorporated by reference in their entirety.

BACKGROUND OF THE INVENTION

1. Field of the Invention

The present invention relates to a reagent refrigerator which provides a low temperature cooling storage for the sake of various experimental reagents generally used in the experimental rooms or research rooms of an university and a company under a safe and environment-friendly condition without an air contamination while minimizing the qualities of reagents and the decrease of titers, and in particular to a reagent refrigerant featuring in that a sealed circulation construction is obtained as a cooler housing is fluid-dynamically separated into a reagent storage cooling compartment and a filter purification compartment in a common cooling mode. In the defrosting and dehumidifying modes, they are partially communicated in a fluid-dynamical way without using a heater, thus obtaining an open circulation structure. The contaminated air in the reagent storage cooling compartment is forced to flow upward and is sucked into a purification compartment provided at an upper side and is purified by a filter installed in it and is cooled by a cooler. The purified and cooled air is forced to flow downward by way of a lateral duct provided in the reagent storage cooling compartment and is discharged into the reagent storage cooling compartment as horizontal flow stream, so the temperature in the reagent storage cooling compartment can be uniform.

2. Description of Related Art

A conventional reagent refrigerator might be formed in a simple storage type like furniture made from a wooden material and a filter purification discharge type using a driving force or a simple ventilation type. The latter type can be classified into an indoor discharge type configured to discharge harmful gas or bad sell to the outside of the reagent refrigerator and an outdoor discharge type configured to discharge into the indoor space.

The filter purification discharge type reagent refrigerator, which is widely used in the recent years, comprises a reagent storage compartment having a transparent window at a front side of it and a plurality of reagent storage trays, and a purification compartment accommodating a ventilator and a cartridge filter and provided above the reagent storage compartment. The harmful gas, bad smell or contaminated air generating in the filter purification discharge type reagent refrigerator is mixed with the externally inputted air and is sucked by the ventilator and then is purified by the cartridge filter and is discharged to the outside.

So, the conventional filter purification discharge type reagent refrigerator is so configured that the air contaminated by harmful gas and bad smell is mixed with the air inputted from the indoor floor on which are stuck a lot of dusts, and the thusly mixed air is supplied into the indoor space. As the air and dusts in the indoor space are inputted into the interior of the reagent refrigerator and are forced to pass through the filter, so the efficiency of the filter is lowered, and the service life of it is shortened. In the above explained conventional reagent refrigerator, what the filter purification efficiency is lowered results in that the air of the indoor space where lots of experiment workers and researchers reside and work might be severely contaminated.

In addition, in case of the filter purification discharge type and the simple ventilation type reagent refrigerator, a duct is connected to the reagent refrigerator so as to avoid the indoor air contamination for thereby discharging the contaminated air to the outdoor space; however in this case the reagent refrigerator is hard to be moved, and since the indoor air is forcibly discharged to the outdoor space, the cooling and heating efficiency of the indoor space is lowered, and the outdoor space might be contaminated by the discharged harmful gas and bad smell.

The above explained reagent refrigerator is not equipped with a certain device for controlling temperature.

In addition, in case of a biological chemical-related reagent which needs a cooling storage, the quality and titer problems occur when storing the reagents in the conventional reagent refrigerator. In any cases, expensive reagents might be wasted.

The reagents which need a cooling storage in a conventional experiment room or a research room are generally stored in a beverage or goods exhibition refrigerator or a home refrigerator with a window at a front side or an upper side of it which is generally used in a supermarket; however these refrigerators are configured in a non-ventilation airtight structure. There are not an anti-explosion function and a gas leak prevention function. For the sake of a defrosting and dehumidifying, it is needed to disconnect power supply. So, the above mentioned devices are not proper for storing the reagents under the cool environment.

In an attempt to improve the above mentioned problems, Korean utility model number 20-0440284 provides a reagent refrigerator 1' featuring in that an external air is inputted from below the reagent refrigerator, and the air above the upper side of the reagent refrigerator is cooled using a cooling unit and is filtered by way of an exhaust port disposed at one side of an upper surface of the reagent refrigerator and is discharged to the outside as shown in FIG. 6.

In more detail, the conventional reagent refrigerator 1' comprises a reagent storage cooling compartment 2 having a suction port 2*a*' and an exhaust port 2*b*' provided at a lower side and an upper side of it, a cooling unit housing 4' having a plurality of ventilation holes 4*a*' formed at its upper side. In the cooling unit housing 4' are installed first and second filter parts 3*a*' and 3*b*' and a cooling unit 4*b*', and at a region neighboring with the exhaust port 2*b*' of the upper side of the reagent storage cooling compartment 2' is provided a blower 4*c*'.

When the air is sucked from the reagent storage cooling compartment 2' with the aid of an exhaust fan (not shown) in the exhaust port 2*b*', the air containing the dust of the floor is inputted from the lower side of the reagent storage cooling compartment 2*c*' and is purified by the first and second filter parts 3*a*' and 3*b*' together with the contaminated and heated air in the interior of the reagent storage cooling compartment 2 and is discharged to the outside. The service lives of the first and second filter parts 3*a*' and 3*b*' are short. When the air cooled by the cooling unit 4*b*' of the upper side of the reagent storage cooling compartment 2' is transferred to the lower side with the aid of the blower 4*c*', since the exhaust fan is installed at a nearby portion, so the cooled air might be sucked by the exhaust fan and might be discharged to the outside or it might be transferred to the lower side. The external air forming an upward stream as it is inputted to a lower side and the cooled air forming a lower stream are deviated, so there is a big temperature difference partially in the reagent storage cooling compartment 2', and the cooling efficiency is low, and it is an open circulation type, which results in bad energy savings.

SUMMARY OF THE INVENTION

Accordingly, it is a first object of the present invention to provide an improved reagent refrigerator which makes it possible to minimize the decreases of qualities and titer of a storage reagent.

It is a second object of the present invention to provide an improved reagent refrigerator which features in high energy savings by adapting a sealed and circulation type structure.

It is a third object of the present invention to provide an improved reagent refrigerator which makes it possible to minimize a cooling temperature difference while efficiently and effectively purifying the air in the reagent refrigerator by improving the flow of an inner circulation stream.

It is a fourth object of the present invention to provide an improved reagent refrigerator which can prolong a service life of a filter by cutting off the input of dusts from the outside.

It is a fifth object of the present invention to provide an improved reagent refrigerator featuring in that harmful gas or bad smell don't input from the reagent refrigerator into the indoor space as a relatively uniform negative pressure is formed in the interior of the reagent storage cooling compartment when a user or a handler opens the door.

It is a sixth object of the present invention to provide a reagent refrigerator which provides an improved safety in such a way that the possibilities of explosion or fire due to flammable or explosive reagents can be prevented when defrosting and dehumidifying the reagent storage cooling compartment.

It is a seventh object of the present invention to provide a reagent refrigerator which can provide an anti-explosion function by selecting a partially open circulation structure.

It is an eighth object of the present invention to provide a reagent refrigerator which makes it possible to monitor in real time an inner environment of a reagent refrigerator and can provide a control at site and a remote control.

To achieve the first to fifth objects of the present invention, according to a first aspect of the present invention, there is provided a reagent refrigerator, comprising a reagent storage cooling compartment having a plurality of reagent storage trays which are installed in parallel from one another; a housing formed of a cooling device compartment and a cooling purification compartment accommodating a blower, a filter and an evaporator and disposed above the reagent storage cooling compartment; a first lateral duct partitioned by a lateral partition wall having a plurality of through holes at one side of the reagent storage cooling compartment and communicating with the cooling purification compartment; a second lateral duct partitioned by a lateral partition wall having a plurality of through holes at the other side of the reagent storage cooling compartment; and an upper duct an end of one side of which communicates with an upper side of the second lateral duct, and an end of the other side of which communicates with a filter of the cooling purification compartment, and the purification cooling air stream formed by the filter and the evaporator forms a downward air stream by way of the first lateral duct by means of the blower, and forms a horizontal air stream toward each tray by way of the through holes of the first lateral partition wall, and forms a downward air stream by way of the net-shaped floor of the tray, and the contaminated, heated air stream in the reagent storage cooling compartment forms an upward air stream in the second lateral duct by way of the plurality of the through holes of the second lateral partition wall, and forms a horizontal air stream in the partitioned upper duct of the upper side of the reagent storage cooling compartment and is converted into a purification cooling air stream by the filters and the evaporator.

To achieve the above first to fifth objects of the present invention, there is provided a reagent refrigerator, comprising a reagent storage cooling compartment having a plurality of reagent storage trays which are installed in parallel from one another; a housing formed of a cooling device compartment and a cooling purification compartment accommodating a blower, a filter and an evaporator and disposed above the reagent storage cooling compartment; a first lateral duct partitioned by a lateral partition wall having a plurality of through holes at one side of the reagent storage cooling compartment and communicating with the cooling purification compartment; a rear duct partitioned by a rear partition wall having a plurality of through holes at a rear side of the reagent storage cooling compartment; and an upper duct an end of one side of which communicates with an upper side of the rear duct spaced apart from the lateral duct, and an end of the other side of which communicates with a filter of the cooling purification compartment, and the purification cooling air stream formed by the filter and the evaporator forms a downward air stream by way of the first lateral duct by means of the lateral duct by the blower, and forms a horizontal air stream toward each tray by way of the through holes of the lateral partition wall, and forms a downward air stream by way of the net-shaped floor of the tray, and the contaminated, heated air stream in the reagent storage cooling compartment forms an upward air stream in the rear duct by way of the plurality of the through holes of the rear partition wall, and forms a horizontal air stream in the partitioned upper duct of the upper side of the reagent storage cooling compartment and is converted into a purification cooling air stream by the filters and the evaporator.

To achieve the above first to fifth objects of the present invention, the filter comprises first to third filters, and in a sequence from the communications with the upper duct, the first filter is a high efficiency particulated (HEPA) arrestor filter or an ultra low penetration absolute (ULPA) filter, and the second filter is a bed filter in which a first type pallet formed of an adsorption agent, a basic oxide and an amphoteric metallic oxide, a second pallet formed of a basic metallic oxide, an oxide and an amphoteric metallic oxide, and a third type pallet formed of a basic metallic oxide and an amphoteric metallic oxide are randomly mixed at a weight percent ratio of 1:1~5:3~10, preferably 1:2~4:5~7 and a third filter is an active carbon or an active carbon fiber non-woven cloth.

To achieve the above first to fifth objects, the evaporator is positioned at a downstream of the filter.

To achieve the above first to fifth objects, the plurality of the through holes formed at the first and second lateral partition walls are formed at the stage of each tray, and the whole surface area of the through holes formed at the stage of each tray gradually increases from the upper portions to the lower portions.

To achieve the above first to fifth objects, in the cooling device compartment are installed a condenser, an expansion valve, a compressor and a ventilator, and an opening and closing valve is installed communicating with the upper duct for a conversion into a partially open structure for the sake of defrosting and dehumidifying operations or an increase control of storage temperature or an anti-explosion.

To achieve the above fist to fifth objects, there are further provided a sensor unit including a gas sensor measuring the concentration of a harmful gas in the interior of the reagent storage cooling compartment, a temperature sensor, a humidity sensor and a flow rate; a data conversion unit converting a detection signal measured by the sensor unit into a digital signal and outputting the signal; a micro controller which controls in real time automatically or manually the operations of the cooling device and the blower and the opening and closing operations of the opening and closing valve and displays the data on the operation condition setting and the operation states in the reagent storage cooling compartment and performs a real time control by way of an on-site or distant personal computer and performs a signal process and a control for the purpose of transmitting a corresponding information to a cellular phone or the personal computer by way of a data server when in emergency; a display controller which receives a data from the micro controller and displays and determines the opening and closing of the opening and closing valve and controls the operations of the cooling device and the blower and processes a signal for outputting the signal from a touch pad or a distant personal computer to the micro controller; and a controller having a touch panel displaying a signal from the display controller, and the temperature, the humidity, the filter efficiency and the flow rate in the reagent storage compartment are in real time displayed, and the operations of the reagent refrigerator can be remotely controlled by way of a touch pad or a distant personal computer.

EFFECTS OF THE INVENTION

The improved reagent refrigerator according to the present invention is capable of controlling the cooling temperature so as to minimize the decreases of quality and titer of storage reagents and is capable of smoothly and effectively purifying the air of the interior of the reagent storage compartment by improving the flow of the inner circulation stream while minimizing the differences of cooling temperatures. The present invention adapts a sealed circulation type structure, thus cutting off the inputs of the dusts from the outside, and the service live can be prolonged. It features in effective energy savings as compared to the open type structure. A uniform negative pressure is formed in the interior of the reagent storage cooling compartment when a user or a handler opens the door, so harmful gas or bad smell does not input from the reagent storage cooling compartment, and an open circulation structure can be partially adapted if needed, so an anti-explosion function can be provided. The defrosting and dehumidifying operations of the reagent storage cooling compartment can be performed by the stream of heats which naturally generate from the condenser and the compressor, not by the heater. Any explosion or fire which might occur due to the flammable or explosive reagents can be eliminated at a low cost, by which safety can be enhanced. A certain number of cartridge filters can be selected and freely adapted, so the usability of it is high. All the operation conditions such as the temperature and moisture of the reagent compartments and the concentration and speed of the harmful gas and the electric power input states can be displayed on a display unit of the reagent compartment and can be automatically controlled or can be displayed on a personal computer of a manager who stays in a distant area or a handler. Such conditions, if needed, might be also recorded on a personal computer of a distant manager or a handler, so it is possible to effectively prevent the decreases or down grade of the titer by way of the optimized reagent storage and management.

DESCRIPTION OF SPECIFIC EMBODIMENTS

The present invention will be described in details with reference to the accompanying drawings.

Figure 1:
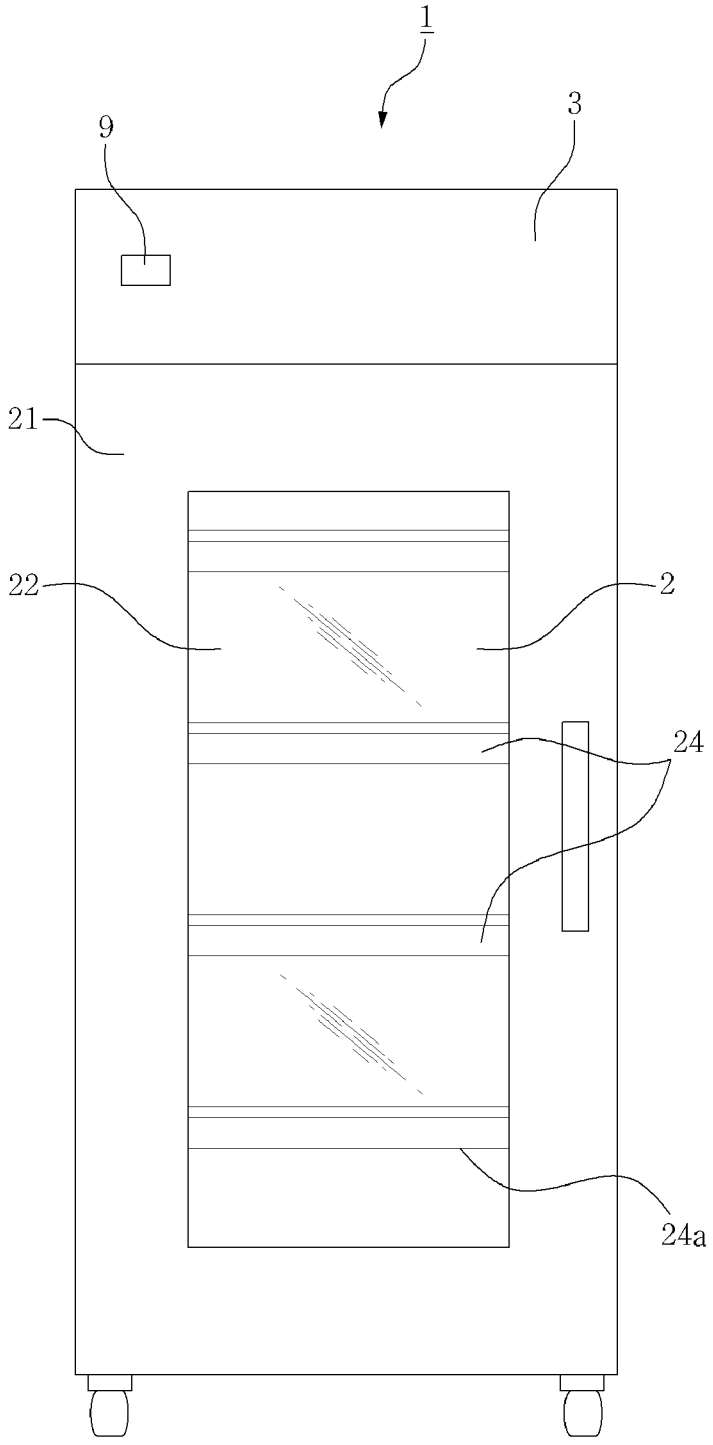
FIG. 1 is a front view illustrating an outer appearance of a reagent refrigerator according to the present invention.
Figure 2:
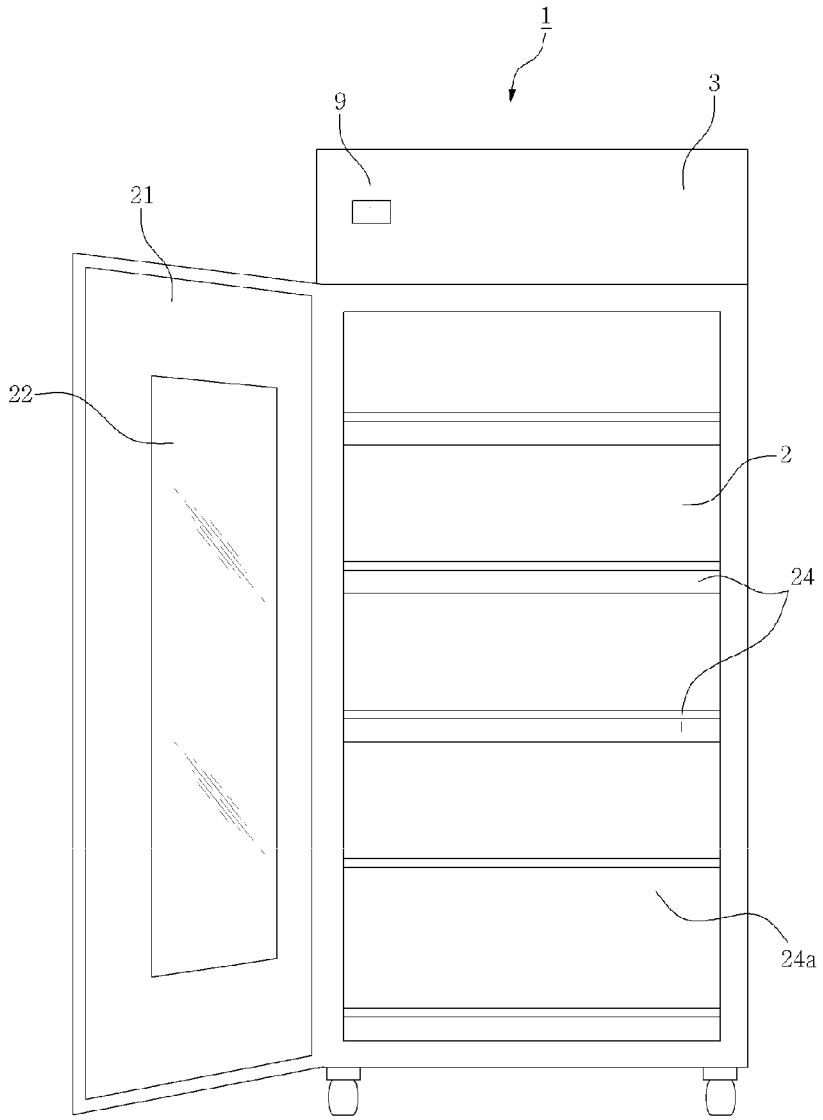
FIG. 2 is a front view of an open state of a door of FIG. 1.

FIG. 1 is a front view illustrating an outer appearance of a reagent refrigerator 1 according to the present invention, and FIG. 2 is a front view illustrating an open state of a door 21 of FIG. 1. The reagent refrigerator of the present invention comprises a reagent storage cooling compartment 2, and a housing 3 provided above the reagent storage cooling compartment 2. A window 22 is installed at the door 21. A plurality of shelves (refer to reference numeral 23 in FIG. 3) are installed in the reagent storage cooling compartment 2 and are spaced apart at regular intervals in the upper and lower structures. A plurality of trays 24 each looking like a drawer is provided at the shelves in withdrawing ways.

The bottom of each tray 24 is formed in a net-shaped bottom 24*a*. A defrosting and dehumidifying heater (not shown) might be installed in the outer frame of the door 21 so as to prevent the formation of steam on the window 22 or a dehumidifying heat cable (not shown) can be attached on an outer surface of the window 22 and a protection film (not shown) might be coated on the surface.

Reference numeral 9 in the drawings represents a controller (specifically, a state display lamp).

Figure 3:
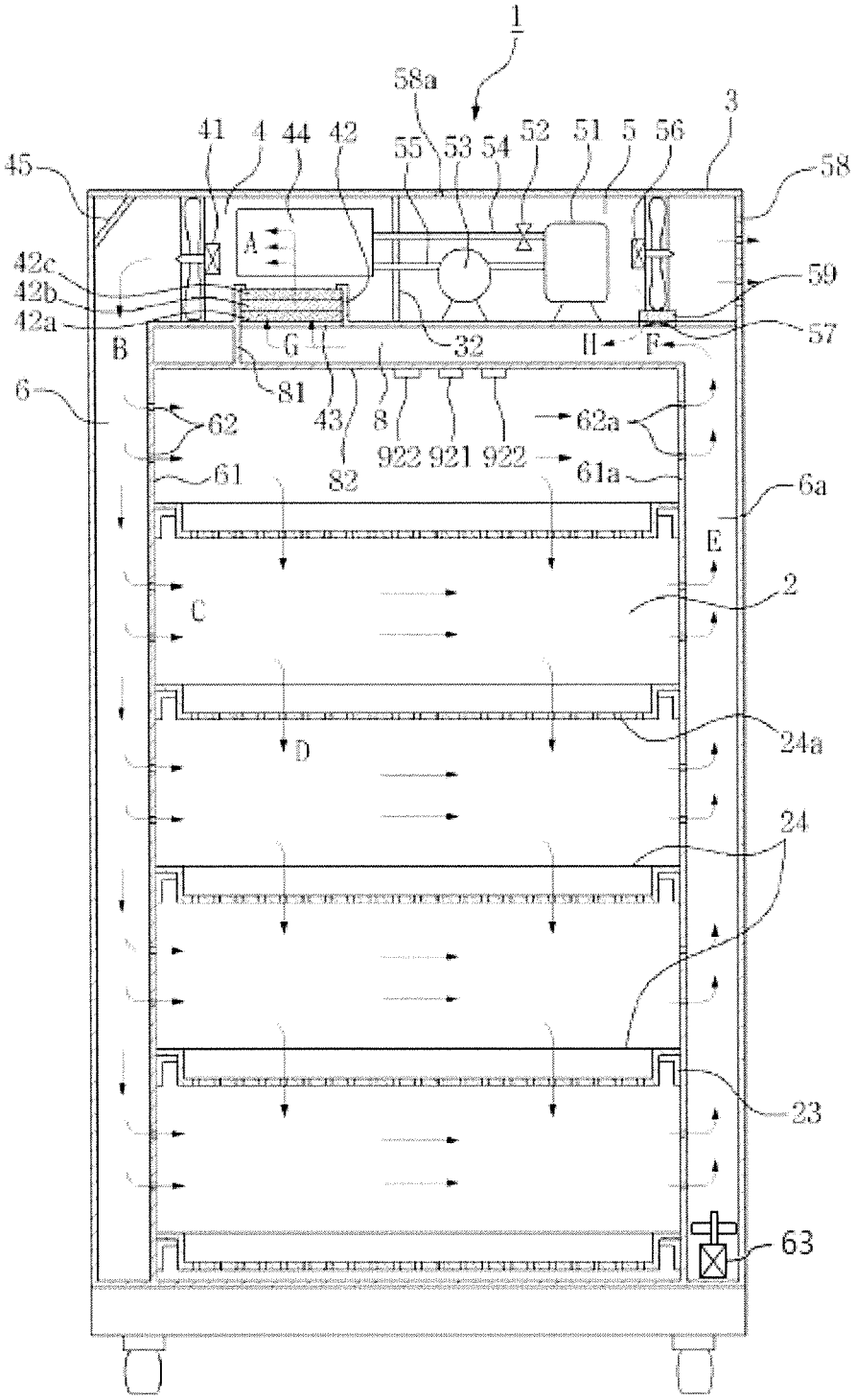
FIG. 3 is a front cross sectional view illustrating a reagent refrigerator according to a first embodiment of the present invention.

FIG. 3 is a front cross sectional view of a reagent refrigerator 1 according to a first embodiment of the present invention. The reagent refrigerator 1 comprises a reagent storage cooling compartment 2 equipped with a plurality of reagent storage trays 24 which are installed in parallel, a cooling purification compartment 4 and a cooling device compartment 5. A housing 3 is provided above the reagent storage cooling compartment 2. First and second lateral ducts 6 and 6*a* and an upper duct 8 are provided at the left and right sides and upper side of the reagent storage cooling compartment 2, respectively.

A blower 41, filters 42*a*, 42*b* and 42*c* and an evaporator (heat exchanger) 44 are installed in the interior of the purification compartment 4 disposed at one side of the housing 3. The first to third filters 42*a*, 42*b* and 42*c* are installed in the interior of the filter housing 42 communicating with the upper duct 8 in a cartridge shape as they are sequentially stacked while forming upper and lower stages. An evaporator 4 is provided at the upper side of it. A blower 41 is provided at a lateral side in its vicinity. The present invention is not limited thereto. Any construction might be adapted as long as the evaporator 44 is disposed at a downstream of the filters 42*a*, 42*b* and 42*c*. For example, the first to third filters 42*a*, 42*b* and 42*c* might be arranged at the left and right sides, and then the evaporator 44 and the blower 41 could be arranged.

The purification cooling stream can be induced downward into the first lateral duct 6 by obliquely installing a guide plate 45 at the upper corner portion of the cooling purification compartment 4 outside the blower 44.

In the cooling device compartment 5 arranged at the other side of the housing 3 are provided the condenser 51, the expansion valve 52, the compressor 53 and the ventilator 56.

The pipeline 54 is fluid-dynamically connected with the condenser 51 and the evaporator 44, and the pipeline 55 is fluid-dynamically connected with the evaporator 44 and the compressor 53.

So, the refrigerant condensed by the condenser 51 is volume-expanded by way of the expansion valve 52 and evaporates by the evaporator 44 and takes surrounding heats and cools the surrounding air, and the heated refrigerant is compressed by the compressor 53 and is liquidified by the condenser 51.

The cooling purification compartment 4 and the cooling device compartment 5 are partitioned by a heat insulation partition wall 32, and the pipelines 54 and 55 pass through the heat insulation partition wall 32.

In the cooling device compartment 5 are provided the ventilator 56 and the through hole 58*a*, so the heat generating from the condenser 51 and the compressor 53 are discharged to the outside by way of a ventilation port 58.

As shown in the drawings, at the lower side of the ventilator 56 is provided an opening and closing valve 57 for a conversion into the partial open structure which is configured for the sake of a defrosting and dehumidifying operation or a control of a storage temperature increase or an anti-explosion. In a communication structure, the heat stream in the cooling device compartment 5 can be forced to flow into the upper duct 8 by means of the ventilator 56, and the filter 59 is engaged above the opening and closing valve 57.

Here, the opening and closing valve 57 can be freely adapted as long as it is provided at the inner side of the ventilator 56.

The first lateral duct 6 is partitioned by the lateral partition wall 61 having a plurality of through holes 62 at one side of the reagent storage cooling compartment 2, and the top of it communicates with the cooing purification compartment 4.

The second lateral duct 6*a* is partitioned by the lateral partition wall 61*a* having a plurality of through holes 62*a* at the other side of the reagent storage cooling compartment 2, and the top of it communicates with the upper duct 8.

The widths of the first and second lateral ducts 6 and 6*a* and the height of the upper duct 8 are not limited; however they are respectively in a range of 3~20 cm, more preferably in a range of 5~15 cm, most preferably in a range of 50~1 cm in a slim construction. If they are respectively in a range of less than 3 cm, respectively, there might be a delay in the flows. On the contrary, if they are respectively in a range of more than 20 cm, the reagent accommodation capacity of the reagent storage cooling compartment 2 significantly decreases as compared to the size of the reagent refrigerator 1.

Figure 4A:
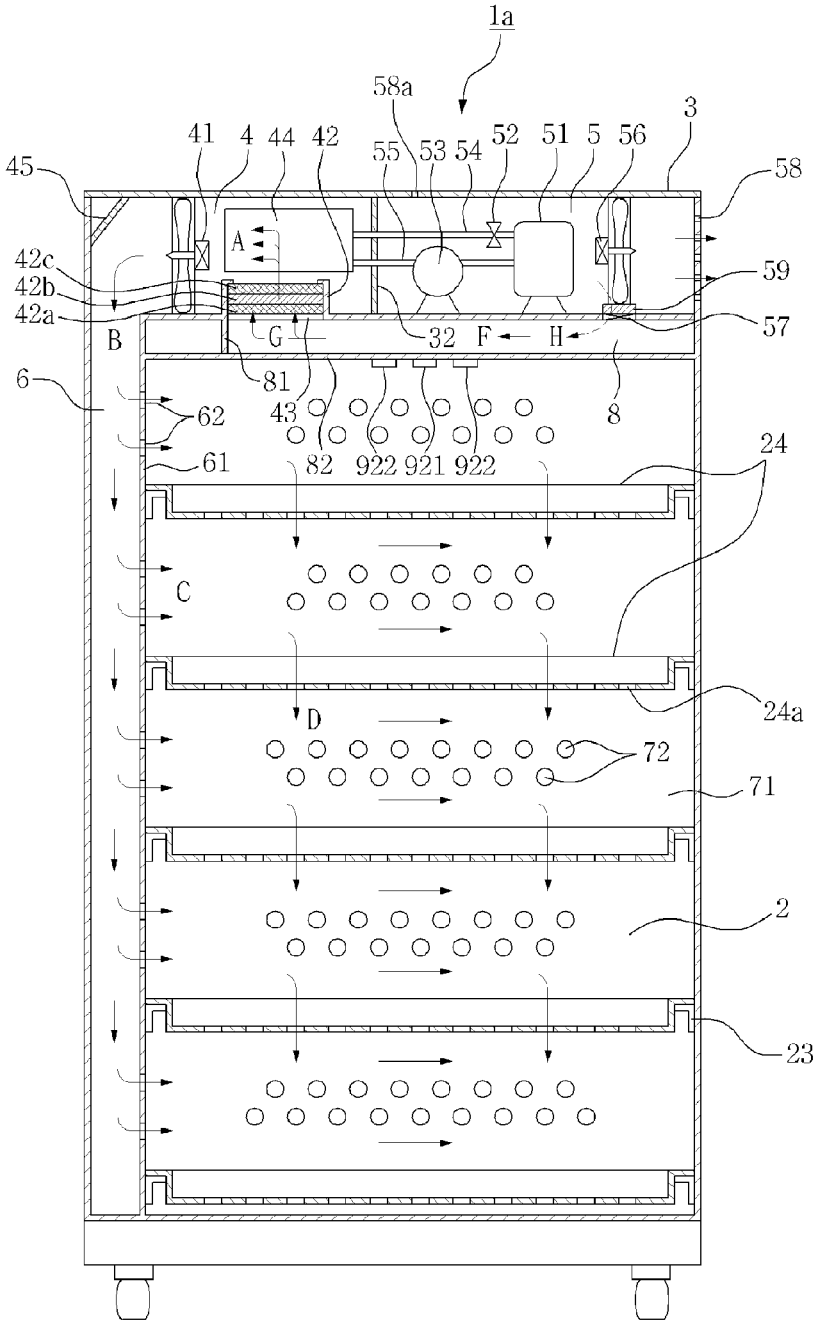
FIG. 4A is a front cross sectional view illustrating a reagent refrigerator according to a second embodiment of the present invention.
Figure 4B:
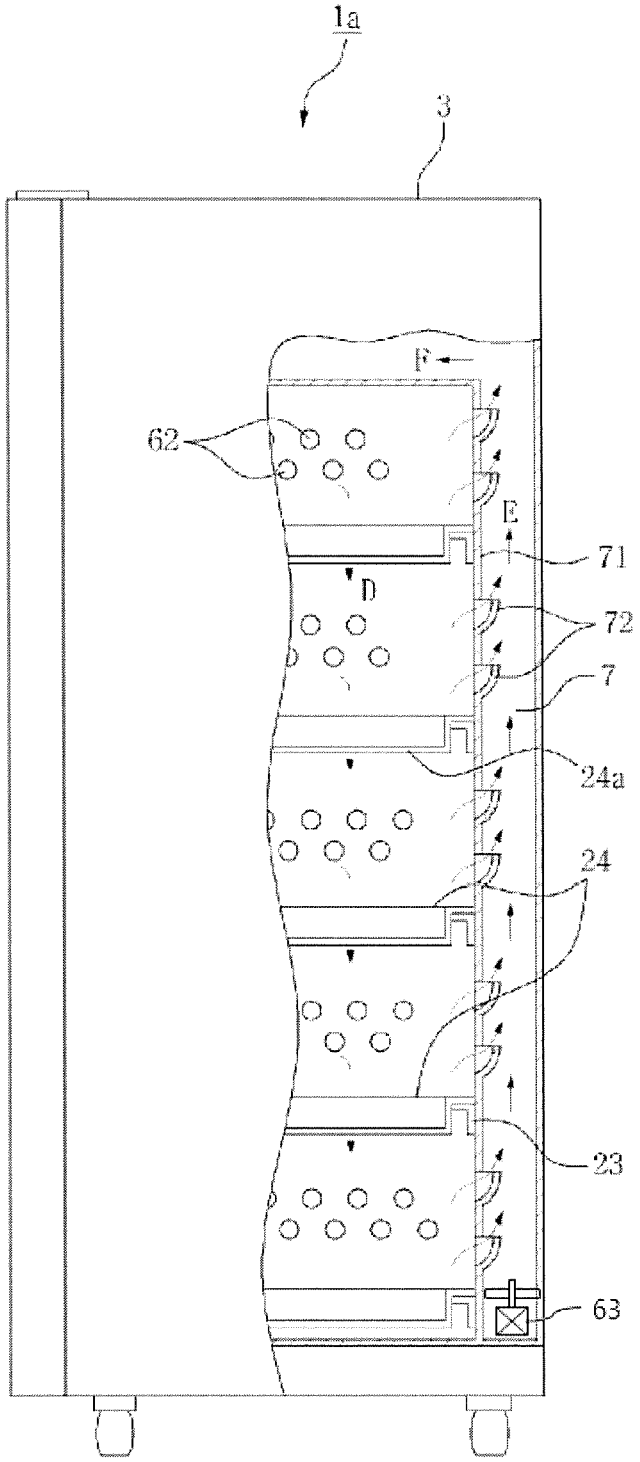
FIG. 4B is a partially cut-away lateral cross sectional view of FIG. 4A.

In the first and second lateral partition walls 61 and 61*a*, a plurality of through holes 62 and 62*a* are formed at each stage of the trays 24, and the whole surface area of the through holes 62 and 62*a* positioned at each stage of the trays 24 gradually increases from the upper stage to the lower stage, and the whole surface area of the through holes 62 and 62*a* between the stages is determined based on the increases in the diameters of the through holes 62 and 62*a* (for example, the diameter of each through hole 62, 62*a* is 25 mm, and the distances between the horizontally and vertically neighboring trough holes 62 or the through holes 62 are 60 mm and 40 mm, and the first stage and the second stage of the upper sides are 13 in numbers, and the third stage and the fourth stage of the center are 15 in number, and the fifth stage of the upper side is 17 in number as shown in FIG. 4*b*). In another manner, it might be determined based on the increases of the diameters (for example, the distance between the neighboring through holes 62 and 62*a* is the same as the above, and in the first stage and the second stage of the upper side, the through hole 62 or 62*a* of the diameter of 25 mm is 13 in number, and in the third stage and the fourth stage of the center, the through hole 62 or 62*a* of the diameter of 26 mm is 13 in number, and in the fifth stage of the lower side, the through hole 62 or 62*a* of the diameter of 27 mm is 13 in number. It is obvious that the above mentioned dimensions might be properly determined in a relatively wider range depending on various parameters such as the capacities of the blower and the cooling device, the widths and the lengths of the first and second lateral ducts 6 and 6*a*, the width and the length of the reagent storage cooling compartment, and the height of each stage of the trays 24, the temperature range of the desired design cooling system, and the flow rate of the inner circulation stream.

The upper duct 8 can be configured with its one end communicating with the upper side of the second lateral duct 6*a*, with the other end communicating with each of the filters 42*a*, 42*b* and 42*c* of the cooling purification compartment 4. At the portion neighboring with the filters 42*a*, 42*b* and 42*c* can be installed a partition wall 81 which helps the contaminated and heated air stream to smoothly input from the upper duct 8 to the filters 42*a*, 42*b* and 42*c*.

The flows of the air circulation streams in the reagent storage cooling compartment 2 and the cooling purification compartment 4 will be described. In the contaminated and heated air stream introduced into the upper duct 8, the purified cooling air stream (flow A) by the filters 42, 42*b* and 42*c* and the evaporator 44 forms a downward air stream (flow B) by way of the first lateral duct 6 by means of the blower 41, and a horizontal air stream (flow C) is formed toward each stray of the trays 24 via the through holes 62 of the first lateral partition wall 61. A downward air stream (flow D) is formed by way of a net-shaped floor 24*a* of each tray 24, and the contaminated and heated air stream in the reagent storage cooling compartment 2 forms an upward air stream (flow E) in the second lateral duct 6*a* by way of the through holes 62*a* of the second lateral partition wall 61*a*, and a horizontal air stream (flow F) is formed by way of the upper duct 8 partitioned from the upper side of the reagent storage cooling compartment 2, and then an upward air stream (flow G) sucked into the filters 42*a*, 42*b* and 42*c* is formed. Finally, the air is filtered by the filters 42*a*, 42*b* and 42*c* and the evaporator 44 and is converted into the cooled and purified cooling air stream (flow A) by means of the heat exchange of the filters 42*a*, 42*b* and 42*c* and the evaporator 44.

When the opening and closing valve 57 is open by the controller (refer to reference numeral 9 of FIG. 1) for the sake of the defrosting and dehumidifying functions or the increase control of the storage temperature or the anti-explosion, it changes to a partially open structure, so with the aid of the blower 56, the heated air generating from the condenser 51 and the compressor 53 in the cooling device compartment 5 is introduced into the upper duct 8 via the filter 59 and the opening and closing valve 57 (refer to the dotted arrow line H). The above explained structure is basically directed to performing the controls of the defrosting and dehumidifying functions and the rising temperatures by means of the heated air without using the heater, so it is possible to eliminate any possible danger factors which might generate owing to the flammable or explosive reagents.

As shown in the drawings, the difference in the flow rate of the horizontal air stream of each tray positioned at the lower side, the central side and the upper side in the interior of the reagent storage cooling compartment 2 of the reagent refrigerator 1 according to the present invention is 0.8 m/sec in max, and it is preferably maintained at below 0.4/sec, and the flow rate of the horizontal air stream in the interior of the reagent storage cooling compartment 2 is uniformly maintained at 0.5~1.5 m/sec.

Since the flow rate is always uniform in the interior of the reagent storage cooling compartment 2, it can have a negative pressure 0.4~0.8 millimeter bar lower, preferably 0.4~0.6 millimeter bar lower than the atmospheric pressure. So, even through a user opens the door, the air of the interior of the reagent storage cooling compartment 2 does not input into the indoor space.

It is preferred that a rod-shaped blower 63 is provided at the second lateral duct 6*a*, preferably, at a lower side of it, thus increasing the rate of the air circulation of the interior of the reagent refrigerator 1.

The reagent refrigerator 1 of the present invention is preferably made from a metallic material, and the outer surface of it is coated by a ceramic or synthetic resin having a chemical resistance. An elastic close-contacting member such as an elastomer or an elastic resin magnet is installed at an inner surface of the door and an outer surface of the body (not shown in the drawing) contacting with the inner surface of it for the purpose of sealing them. The window 22 configured for a user to visually check the interior of the reagent storage cooling compartment 2 is made from a transparent material such as glass, acryl, polycarbonate, etc.

In the housing 3 is provided a controller 9. At the front side of the housing 3 is installed a door (reference numeral is not given), by which construction it becomes easy to perform works such as an exchange of part, a cleaning, etc. of the filter housing 24 and the checks or repairs with respect to the internal elements in the cooling purification compartment 4 and the cooling device compartment 5.

The filters 42*a*, 42*b* and 42*c* adapted to the reagent refrigerator 1 according to the present invention will be described.

The first to third filters 42*a*, 42*b* and 42*c* are provided in the cartridge shapes in the filter housing 42 of the cooling purification compartment 4. In the present invention, the mounting sequences of the first to third filters 42*a*, 42*b* and 42*c* are not limited thereto, and such sequences might be freely changed. For simplifications, it will be explained from the side to which the upper duct 8 is connected for the sake of communications. Here, the first filter 42*a* is a high efficiency particulated arrester (HEPA) filter or an ultra low penetration absolute (ULPA) filter. The second filter 42*b* is a bead filter in which a first type pallet formed of an adsorption agent, a basic oxide and an amphoteric metallic oxide, a second type pallet formed of a basic metallic oxide, an oxide and an amphoteric metallic oxide, and a third type pallet formed of a basic metallic oxide and an amphoteric are randomly mixed at a weight percent of 1:1~5:3~10, preferably, at a weight percent of 1:2~4:5~7. The third filter is a carbon filter formed of an active carbon or an active carbon fiber-woven cloth.

The first filter 42*a* is a known element, and it will be described in more details. The HEPA filter is made from a micro glass fiber and is generally used so as to filter 0.3 μm granules. The filter having a collection efficiency of above 99.7% by means of a standard dioctyl-phthalate counting method, preferably above 99.97% is generally used. The initial loss in pressure is 24~26 mmAq, and the end loss of pressure is 46~55 mmAq. The ULPA filter is made from an ultra micro glass fiber and is capable of filtering the granules of 0.1~0.17 μm above 9.99%, preferably, 99.9995%, and the initial loss of pressure is 25~27 mmAq, and the end loss of pressure is 50~58 mmAq.

In the present invention, the first filter 42*a* can be selected between the HEPA filter and the ULPA filter depending on the kinds of storage reagents, the installation place and the purpose of it. For the sake of a common use, the HEPA filter is generally selected in consideration of the costs and maintenances.

The second filter 42*b* is made from the first type pallet formed of 50~65 weight % of adsorption agents, 15~30 weight % of basic metallic oxides, 5~15 weight % of amphoteric metallic oxides and a 5~15 weight % of binders, the second type pallet formed of 25~40 weight % of basic metallic oxides, 25~40 weight % of oxides, 25~40% of oxides, 25~40 weight % of amphoteric metallic oxides and 5~15 weight % of binders, and the third type pallet formed of 50~70 weight % of basic metallic oxides, 20~40 weight % of amphoteric metallic oxides and 5~15 weight % of binders.

Here, the basic metallic oxide is at least one compound selected from the group consisting of $Na_2O$, $K_2O$, $Rb_2O$, $Cs_2O$, MgO, CaO, SrO, BaO, CrO, $Ti_2O_3$, $Cr_2O_3$, MnO and $Mn_2O3_3$, and the amphoteric metallic oxide is at least one compound selected from the group consisting of $Al_2O_3$, $SnO_2$ and $PbO_2$, and the oxide is $KMnO_4$ or $MnO_2$ or $PbO_2$, and the adsorption agent is an active carbon, and the binder is silica sol, sodium carboxy methyl cellulose (CMC) or pulp powder.

The first, second and third pallets are randomly accommodated in the cartridge with a plurality of small pores, thus forming a movable pallet bed as the second filter.

In more details, the first type pallet has a pore volume of 1.91~2.17 cc/g, a specific surface area (BET) of 920~970 $m^2/g$ and a pressure loss of 8.8~9.3 mmAq/5 cm height, and the second type pallet has a pore volume of 1.02~1.18 cc/g, a specific surface area (BET) of 766~792 $m^2/g$ and a pressure loss of 7.6~8.4 mmAq/5 cm height, and the third type pallet has a pore volume of 1.57~1.69 cc/g, a specific surface area (BET) of 788~823 $m^2/g$ and a pressure loss of 7.7~8.2 mmAq/5 cm height.

The pelletization for the sake of the first to third type pallets features in that the above mentioned components are processed with a ball milling to have 150~1200 meshes, and are manufactured in a certain shape and size using a pelletization unit. In the present invention, the contents of the water of the first to third type pallets are 5 weight % in max.

The third filter 42*c* is a carbon filter, and it is a non-woven filter into which are added an active carbon and basic metallic oxide or an active carbon filter non-woven filter into which is added a basic metallic oxide. In case of a natural fiber or artificial fiber non-woven filter into which is added an active carbon and a basic metallic oxide, an active carbon of 70~85 weight %, a basic metallic oxide of 10~25 weight % and a binder of 3~8 weight % are uniformly mixed and coated on the non-woven cloth. In case of an active carbon fiber non-woven filter into which is added a basic metallic oxide, a basic metallic oxide of 80~95 weight % and a binder of 5~20 weight % are uniformly mixed and coated.

The common physical properties of the active carbon fiber non-woven cloth which can be easily purchased in the market have a density of 100~300 $g/m^3$, a thickness of 1~6 mm, and a density of 0.04~0.1 $g/cm^3$.

The filter 59 engaged at an upstream or a downstream next to the opening and closing valve 57 is a pre-filter or a pre-filter and high efficiency particulated arrestor (HEPA) or a pre-filter and ultra low penetration absolute (ULPA).

Here, the pre-filter might be a non-woven filter made from PVC, PE or PP which can be recycled as a known filter or a porous sponge filter or a glass fiber filter which cannot be recycled. It is preferred that the pre-filter has a greater dust collection efficiency of 60~85%, and an initial pressure loss of 5.5~8.5 mmAq ($H_2O$).

The kinds, thickness and density of the cartridge configured to accommodate the first to third filters 42*a*, 42*b* and 42*c* and the filter 59 might be properly selected or combined in a range so that the above mentioned flow rate and negative pressure level can be maintained in consideration of various parameters such as the natures and characteristics of the reagents stored in the reagent storage cooling compartment 2, the estimated filter exchange period, the size of the reagent refrigerator, a targeted safety level, the capacity of the blower, the defrosting and dehumidifying conditions and the frequencies of uses. The position sequences of the cartridges can change if needed.

The reagent refrigerator according to the present invention can be controlled in a range of 3~25° C., preferably 3~18° C., most preferably 3~10° C.

FIGS. 4A and 4B are a front cross sectional view and a partially cut-away lateral cross sectional view illustrating a reagent refrigerator 1 of FIG. 3 of the second embodiment of the present invention. Comparing to the reagent refrigerator 1 of FIG. 3 according to the first embodiment of the present invention, the whole constructions are same as the second embodiment except that the rear duct 7 is installed instead of the second lateral duct 6*a* of FIG. 3, and the descriptions on the same construction will be omitted.

The reagent refrigerator 1*a* of FIGS. 4A and 4B is not equipped with the second lateral duct 6*a* belonging to the reagent refrigerator 1 of FIG. 3, so the functions of the second lateral duct 6*a* is conducted by the rear duct 7 in the present embodiment. The other constructions are same.

As a different feature, only the upper rear portion (right upper side in the drawing) of the rear duct 7 spaced apart from the lateral duct 6 in the structure of the reagent refrigerator 1*a* is partially open and communicates with the upper duct 8. The above mentioned structure is helpful to achieve the uniform temperature distribution in the reagent storage refrigerator 2.

In the reagent refrigerator 1*a* according to the second embodiment of the present invention as shown in FIGS. 4A and 4B, the flows of the air circulation stream in the reagent storage cooling compartment 2 and the cooling purification compartment 4 will be described. In the contaminated and heated air stream introduced from the upper duct 8, the purification cooling air stream (flow A) formed by the filters 4*a*, 42*b* and 42*c* and the evaporator 44 forms a downward air stream (flow B) by way of the lateral duct 6 by the blower 41 and forms a horizontal air stream (flow C) toward the stage of each tray 24 by way of the plurality of the through holes 62 of the lateral partition wall 61 and forms a downward air stream (flow D) by way of the net-shaped floor 24*a* of each tray 24, and the contaminated and heated air stream in the reagent storage cooling compartment 2 forms an upward air stream (flow E) in the rear duct 7 by way of a plurality of through holes 72 of the rear partition wall 71 of the rear duct 7 and then forms a horizontal air stream (flow F) by way of the upper duct 8 partitioned in the upper side of the reagent storage cooling compartment 2 and forms an upward air stream (flow G) sucked into the filters 42*a*, 42*b* and 42*c* and is finally converted into a purified air stream (flow A) filtered by the filters 42*a*, 42*b* and 42*c* and the evaporator 44 and cooled after heat exchanges and is transferred by the blower 41.

When the opening and closing valve 57 is opened for the sake of a defrosting and dehumidifying operation or a control of the increase of the storage temperature or an anti-explosion operation, it is converted into a partial opening structure, and the heated air stream is introduced (indicated by the dotted arrow H) into the upper duct 8 by way of the filter 59 and the opening and closing valve 57 by means of the blower 56, the operation of which is same as the earlier operation.

The constructions of the plurality of the through holes 72 of the rear partition wall 71 of the rear duct 7 are same as the first and second lateral partition walls of FIG. 3. The remaining constructions such as the flow rate and negative pressure range of the interior of the reagent storage cooling compartment 2 of the reagent refrigerator 1*a* are actually same as the constructions as shown in FIG. 3, so the descriptions thereon will be omitted.

Figure 5:
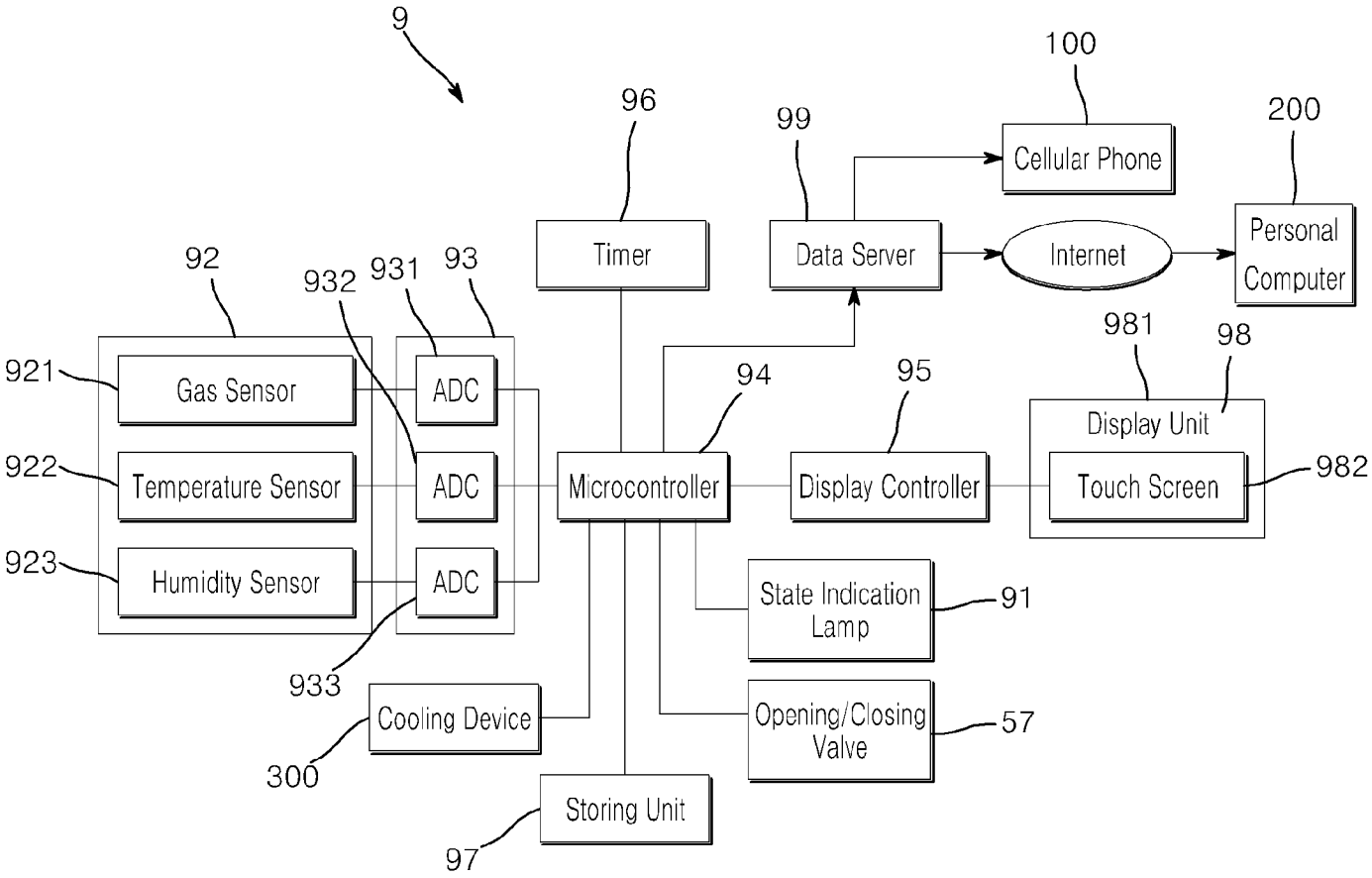
FIG. 5 is a block diagram illustrating a control system which is adapted to a reagent refrigerator of FIG. 1 according to the present invention.
Figure 6:
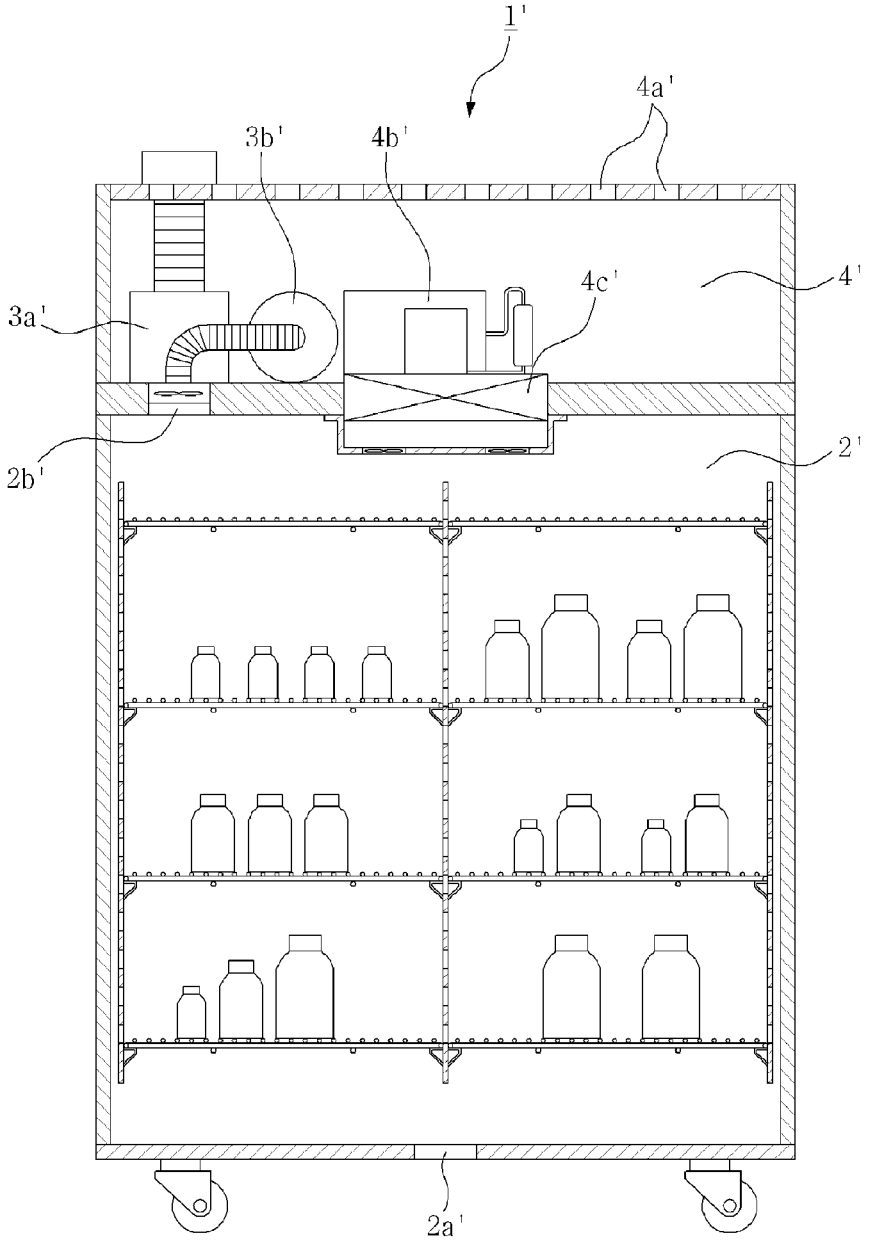
FIG. 6 is a vertical cross sectional view illustrating a conventional reagent refrigerator.

FIG. 5 is a block diagram illustrating a controller 9 adapted to a sealed circulation type reagent refrigerator 1 according to the present invention, and the sealed circulation type reagent refrigerator 1*a*, 1*b* according to the present invention as shown in FIGS. 5 and 6 can be commonly adapted to the above described examples.

The controller 9 comprises a sensor unit 92 formed of a gas sensor 921 measuring the concentration of a harmful gas in the reagent storage cooling compartment 2, a temperature sensor 922, a moisture sensor 923 and a flow rate sensor (not shown). The detection signal measured by the sensor unit 92 is converted into a digital signal by the analog-digital converters 931, 932 and 933 of the data conversion unit 93 and is outputted. The microcontroller 94 automatically or manually controls in real time the operations of the cooling devices 51, 52, 53 and 54 and the blower 41 and the opening and closing of the opening and closing valve 57 based on the digital signal. It also helps display the data on the operation condition setting and operation states of the reagent storage cooling compartment 2 while performing a real-time control by way of an on-site or distant personal computer and performing signal processes and controls for the purpose of transmitting a corresponding information to the cellular phone 100 or the personal computer 200 by way of the data server 99. The timer 96 serves to reserve an operation time on a specific condition such temperature, humidity, flow rate, concentration of harmful gas, etc. The display controller 95 is configured to receive a data from the microcontroller 94 and display it and process a signal for the purpose of outputting to the microcontroller 94 a signal inputted from the touch pad (or touch screen) 982 or a signal from the distant personal computer 200 while displaying a signal from the display controller 95 on the display unit 98.

The temperature, humidity and the concentration of harmful gas in the reagent storage cooling compartment 2 and the filter efficiency and the flow rate are in real time displayed on the touch pad 982 and the distant personal computer 200 and are stored in the storing unit 98. The different operation states changing upon the operations of the microcontroller 94 in response to an input signal are automatically controlled or in real time controller. In case of abnormal operations or power failures, an alarm function using a short message service (SMS) or an e-mail could be transmitted to the cellular phone 100 or the personal computer 200 by way of the data server 99.

The present invention has been described with the detailed embodiments; however it is obvious that an ordinary person skilled in the art can modify or amend the disclosures without departing the concepts scopes of the present invention.

What is claimed is:

1. A reagent refrigerator, comprising:

a reagent storage cooling compartment having a plurality of reagent storage trays which are installed in parallel from one another;

a housing formed of a cooling device compartment and a cooling purification compartment accommodating a blower, a filter and an evaporator and disposed above the reagent storage cooling compartment;

a first lateral duct partitioned by a lateral partition wall having a plurality of through holes at one side of the reagent storage cooling compartment and communicating with the cooling purification compartment;

a second lateral duct partitioned by a lateral partition wall having a plurality of through holes at the other side of the reagent storage cooling compartment; and an upper duct having an end of one side of which communicates with an upper side of the second lateral duct, and an end of another side of which communicates with a filter of the cooling purification compartment, wherein a purification cooling air stream formed by the filter and the evaporator forms a downward air stream by way of the first lateral duct by means of the blower, and forms a horizontal air stream toward each reagent storage tray by way of the plurality of through holes of the first lateral partition wall, and forms a downward air stream by way of a floor of the reagent storage trays containing a plurality of holes, and a contaminated, heated air stream in the reagent storage cooling compartment forms an upward air stream in the second lateral duct by way of the plurality of the through holes of the second lateral partition wall, and forms a horizontal air stream in the upper duct of the upper side of the reagent storage cooling compartment and is converted into a purification cooling air stream by the filter and the evaporator, and wherein the filter comprises first to third filters, and in a sequence from the communications with the upper duct, the first filter is a high efficiency particulated arrestor (HEPA) filter or an ultra low penetration absolute (ULPA) filter, and the second filter is a bed filter in which a first type pallet formed of an adsorption agent, a basic oxide and an amphoteric metallic oxide, a second pallet formed of a basic metallic oxide, an oxide and an amphoteric metallic oxide, and a third type pallet formed of a basic metallic oxide and an amphoteric metallic oxide are randomly mixed at a weight percent ratio of 1:1~:3~10, and a third filter is an active carbon or an active carbon fiber non-woven cloth.

2. The reagent refrigerator of claim 1, wherein in the second filter, the first type pallet is formed of the adsorption agent of 50~65 weight %, the basic metallic oxide of 15~30 weight %, the amphoteric metallic oxide of 5~15 weight % and a binder of 5~15 weight %, and the second type pallet is formed of the basic metallic oxide of 25~40 weight %, oxide of 25~40 weight %, an amphoteric metallic oxide of 25~40 weight % and a binder of 5~15 weight %, and the third type pallet is formed of the basic metallic oxide of 50~70 weight %, the amphoteric metallic oxide of 20~40 weight % and a binder of 5~15 weight %, and the basic metallic oxide is at least one compound selected from the group consisting of $Na_2O$, $K_2O$, $Rb_2O$, $Cs_2O$, MgO, CaO, SrO, BaO, CrO, $Ti_2O_3$, $Cr_2O_3$, MnO and $Mn_2O_3$, and the amphoteric metallic oxide is at least one compound selected from the group consisting of $Al_2O_3$, $SnO_2$ and $Pb\mathbf{0}_2$, and the oxide is $KMnO_4$ or $MnO_2$ or $PbO_2$, and the adsorption agent is an active carbon, and the binder is silica sol, sodium carboxy methyl cellulose (CMC) or pulp powder, and the first, second and third pallets are accommodated in the cartridge with a plurality of small pores for thereby forming a movable pallet bed.

3. The reagent refrigerator according to claim 2, wherein the first type pallet has a pore volume of 1.91~2.17cc/g, a specific surface area (BET) of 920~970$m^2$/g and a pressure loss of 8.8~9.3mmAq/5cm height, and the second type pallet has a pore volume of 1.02~1.18cc/g, a specific surface area (BET) of 766~792$m^2$/g and a pressure loss of 7.6~8.4mmAq/5cm height, and the third type pallet has a pore volume of 1.57~1.69cc/g, a specific surface area (BET) of 788~823$m^2$/g and a pressure loss of 7.7~8.2mmAq/5 cm height.

4. The reagent refrigerator according to claim 1, wherein the evaporator is positioned at a downstream of the filter.

5. The reagent refrigerator according to claim 1, wherein the plurality of the through holes formed at the first and second lateral partition walls are formed at a position corresponding to the stage of each of the reagent storage trays, and the whole surface area of the plurality of the through holes gradually increases from upper portions to lower portions.

6. The reagent refrigerator of claim 5, wherein the increase of the whole surface area of the plurality of the through holes is based on the increase of the through holes having the same diameters or the increase of the diameter in the same numbers.

7. The reagent refrigerator of claim 1, wherein at an upper side of the cooling purification compartment is installed a guide plate for guiding downward the purification cooling air stream, and a partition wall is provided for the sake of a smooth introduction of the contaminated and heated air stream from the upper duct to the filter.

8. The reagent refrigerator of claim 1, wherein in the cooling device compartment are installed a condenser, an expansion valve, a compressor and a ventilator, and an opening and closing valve is installed communicating with the upper duct for a conversion into a partially open structure for the sake of defrosting and dehumidifying operations or an increase control of storage temperature or an anti-explosion.

9. The reagent refrigerator according to claim 8, wherein a pre-filter or a combination of a pre-filter and a high efficiency particulated arrestor (HEPA) or a combination of a pre-filter and ultra low penetration absolute (ULPA) filer is provided at an upstream or a downstream in vicinity of the opening and closing valve.

10. The reagent refrigerator according to claim 1, wherein the reagent storage cooling compartment is equipped with a door at a front side of which is provided a window, and a heating cable for a dehumidifying function is attached in the interior of the frame of the door or on a front side of the window, and a protection film is coated on the window.

11. The reagent refrigerator according to claim 8, wherein the opening and closing valve is positioned at a lower side of a blade of the ventilator, and the heated air stream generating from the compressor and the condenser by the ventilator when the opening and closing valve is open is introduced into the upper duct by way of the opening and closing valve.

12. The reagent refrigerator of claim 1, wherein a rod-shaped blower is provided at a lower side of the second lateral duct.

13. The reagent refrigerator of claim 1, wherein the width of the first and second lateral duct and the height of the upper duct are 3~20cm, and the difference in the flow rates of the trays positioned at the lower side, central side and upper side of the interior of the reagent storage cooling compartment is 0.8 m/sec in max, and the flow rate of the interior of the reagent storage cooling compartment is 0.5~1.5 m/sec, and the interior of the reagent storage cooling compartment has a negative pressure state 0.4~0.8 millimeter lower than the atmospheric pressure.

14. The reagent refrigerator of claim 1, further comprising:

a sensor unit including a gas sensor measuring the concentration of a harmful gas in the interior of the reagent storage cooling compartment, a temperature sensor, a humidity sensor and a flow rate;

a data conversion unit converting a detection signal measured by the sensor unit into a digital signal and outputting the digital signal;

a micro controller which controls in real time automatically or manually the operations of the cooling device compartment and the blower and the opening and closing operations of the opening and closing valve and displays the data on an operation condition setting and operation states in the reagent storage cooling compartment and performs a real time control by way of an on-site or a distant personal computer and performs a signal process and a control for the purpose of transmitting a corresponding information to a cellular phone or the distant personal computer by way of a data server when in emergency;

a display controller which receives a data from the micro controller and displays and determines the opening and closing of the opening and closing valve and controls the operations of the cooling device and the blower and processes a signal for outputting the signal from a touch pad or a distant personal computer to the micro controller; and a controller having a touch panel displaying a signal from the display controller, and the temperature, the humidity, the filter efficiency and the flow rate in the reagent storage compartment are in real time displayed, and the operations of the reagent refrigerator can be remotely controlled by way of the touch pad or the distant personal computer.

15. A reagent refrigerator, comprising:

a reagent storage cooling compartment having a plurality of reagent storage trays which are installed in parallel from one another;

a housing formed of a cooling device compartment and a cooling purification compartment accommodating a blower, a filter and an evaporator and disposed above the reagent storage cooling compartment;

a first lateral duct partitioned by a lateral partition wall having a plurality of through holes at one side of the reagent storage cooling compartment and communicating with the cooling purification compartment;

a rear duct partitioned by a rear partition wall having a plurality of through holes at a rear side of the reagent storage cooling compartment; and an upper duct having an end of one side of which communicates with an upper side of the rear duct spaced apart from the lateral duct, and an end of the other side of which communicates with a filter of the cooling purification compartment, wherein a purification cooling air stream formed by the filter and the evaporator forms a downward air stream by way of the first lateral duct by the blower, and forms a horizontal air stream toward each reagent storage tray by way of the through holes of the lateral partition wall, and forms a downward air stream by way of a floor of the reagent storage trays containing a plurality of holes, and a contaminated, heated air stream in the reagent storage cooling compartment forms an upward air stream in the rear duct by way of the plurality of the through holes of the rear partition wall, and forms a horizontal air stream in the upper duct of the upper side of the reagent storage cooling compartment and is converted into a purification cooling air stream by the filter and the evaporator, and wherein the filter comprises first to third filters, and in a sequence from the communications with the upper duct, the first filter is a high efficiency particulated arrestor (HEPA) filter or an ultra low penetration absolute (ULPA) filter, and the second filter is a bed filter in which a first type pallet formed of an adsorption agent, a basic oxide and an amphoteric metallic oxide, a second pallet formed of a basic metallic oxide, an oxide and an amphoteric metallic oxide, and a third type pallet formed of a basic metallic oxide and an amphoteric metallic oxide are randomly mixed at a weight percent ratio of 1:1~5:3~10, and a third filter is an active carbon or an active carbon fiber non-woven cloth.

16. The reagent refrigerator of claim 15, wherein the plurality of through holes formed at the lateral partition wall and the rear partition wall are formed at a position corresponding to the stage of each of the reagent storage trays, and the whole surface area of the plurality of the through holes gradually increases from upper portions to lower portions.

17. The reagent refrigerator of claim 15, wherein a rod-shaped blower is provided at a lower side of the rear duct spaced apart from the lateral duct.

18. The reagent refrigerator of claim 15, wherein in the second filter, the first type pallet is formed of the adsorption agent of 50~65 weight %, the basic metallic oxide of 15~30 weight %, the amphoteric metallic oxide of 5~15 weight % and a binder of 5~15 weight %, and the second type pallet is formed of the basic metallic oxide of 25~40 weight %, the oxide of 25~40 weight %, the amphoteric metallic oxide of 25~40 weight % and a binder of 5~15 weight %, and the third type pallet is formed of the basic metallic oxide of 50~70 weight %, the amphoteric metallic oxide of 20~40 weight % and a binder of 5~15 weight %, and the basic metallic oxide is at least one compound selected from the group consisting of $Na_2O$, $K_2O$, $Rb_2O$, $Cs_2O$, MgO, CaO, SrO, BaO, CrO, $Ti_2O_3$, $Cr_2O_3$, MnO and $Mn_2O_3$, and the amphoteric metallic oxide is at least one compound selected from the group consisting of $Al_2O_3$, $SnO_2$ and $PbO_2$, and the oxide is $KMnO_4$ or $MnO_2$ or $PbO_2$, and the adsorption agent is an active carbon, and the binder is silica sol, sodium carboxy methyl cellulose (CMC) or pulp powder, and the first, second and third pallets are accommodated in the cartridge with a plurality of small pores for thereby forming a movable pallet bed.

* * * * *